US006047158A

United States Patent [19]

Morigami et al.

[11] Patent Number: 6,047,158

[45] Date of Patent: Apr. 4, 2000

[54] FIXING DEVICE HAVING A HEAT MOVING MEMBER

[75] Inventors: Yuusuke Morigami, Toyohashi; Tetsuro Ito, Anjo; Takeshi Kato, Itami; Taizou Oonishi, Toyokawa, all of Japan

[73] Assignee: Minolta Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/092,013

[22] Filed: Jun. 4, 1998

[30] Foreign Application Priority Data

Jun. 4, 1997 [JP] Japan ..... 9-146536

[51] Int. Cl.[7] ..... G03G 15/20

[52] U.S. Cl. ..... 399/328; 219/216

[58] Field of Search ..... 399/320, 322, 399/328, 330, 331; 219/469, 470, 471, 216

[56] References Cited

U.S. PATENT DOCUMENTS 4,063,530 12/1977 Thettu et al. ..... 399/328
4,079,227 3/1978 Takiguchi ..... 219/216

*Primary Examiner*—Susan S. Y. Lee
*Attorney, Agent, or Firm*—McDermott, Will & Emery

[57] ABSTRACT

A fixing device having a rotatable heating member heated by a heat source, a rotatable pressure member for pressing against the rotatable heating member, a heat-moving member formed of material having excellent thermal conductivity characteristics and constructed so as to freely make contact with at least one rotatable member among the rotatable heating member and the rotatable pressure member, and a drive unit to move the heat-moving member between a contact position and retracted position relative to at least one of the heating member and the rotatable pressure member. The heat-moving member changes either heat capacity or thermal conductivity or both heat capacity and thermal conductivity relative to the axial direction of the rotatable heating member or the rotatable pressure member.

18 Claims, 8 Drawing Sheets

TEMPERATURE OF HEATING ROLLER WHEN SMALL SIZE SHEETS ARE CONTINUOUSLY TRANSPORTED.

TEMPERATURE OF HEATING ROLLER WHEN SMALL SIZE SHEETS ARE CONTINUOUSLY TRANSPORTED

FIXING DEVICE HAVING A HEAT MOVING MEMBER

This application is based on Application No. 9-146536 filed in Japan, the contents of which are hereby incorporated by reference.

FIELD OF THE INVENTION

The present invention relates to a fixing device for use in image forming apparatus such as copiers, printer, facsimiles and the like of the electrophotographic type, and more specifically relates to a fixing device which fixes a toner image, formed on a sheet, to the sheet by thermal fusion of the toner.

DESCRIPTION OF THE RELATED ART

Copiers and the like of the electrophotographic type are provided with a fixing device for fusing, via heat, a toner image transferred onto a sheet, such as a recording sheet or transfer sheet, functioning as a recording medium so as to fix the toner image to the sheet.

Typical heating roller type fixing devices are provided with a heating roller to melt the toner on the sheet, and a pressure roller to press against the heating roller with the sheet interposed there between. The heating roller is hollow and supports a heat source, such as a halogen lamp or the like, on its center axis. The exterior wall temperature of the heating roller is heated to a temperature suitable for fixing, and in this state, the heating roller and the pressure roller rotate in mutually opposite directions while in mutual contact so as to grip, there between, a sheet bearing a toner image. In the contact area between the heating roller and pressure roller (hereinafter referred to as the "nip area"), the toner maintained on the sheet is melted by the heat of the heating roller and fixed on the sheet via the pressure action from both rollers.

Demand has grown in recent years for fixing devices which conserve energy as well as improve temperature elevation time, i.e., reduce the warm up time for the surface temperature of the heating roller, and to this end the heating capacity, i.e., thickness, of the heating roller functioning as a rotatable heating member has been designed to be thinner to reduce the warm up time without increasing the power consumption of the heating roller fixing device.

In conjunction with the aforesaid thinning of the heating roller, there is a loss of thermal conductivity in the lengthwise direction (axial direction) and circumferential direction of the roller.

Therefore, in modes for continuously feeding recording sheets of a size smaller than the maximum fed sheet width, as frequently used in copiers and the like, the temperature difference between the temperature of the heating roller when in contact with the recording sheet and the temperature of the heating roller when not in contact with the recording sheet becomes extremely large. This temperature discrepancy causes concern about reduced heat resistance service life of peripheral components, as well as heat damage. Furthermore, since uniform temperature distribution is not maintained in the axial direction, perpendicular to the sheet transport direction, disadvantages arise relative to fixing characteristics such as local irregularities and so-called high temperature offset wherein toner adheres to the heating roller when a recording sheet of a larger size is fed directly after the aforesaid mode.

Japanese Laid-Open Patent Application No. HEI 7-64420 discloses as a counter measure for the aforesaid problem. A heat fixing device is provided with a heat-equalizing roller as member for moving the heat to at least one or another of a heating roller or pressure roller. The heat-equalizing roller is disposed so as to make contact while being freely retractable.

In this fixing device, however, no consideration is given to the heating capacity or thermal conductivity of the heat-moving member, and there is concern that inadequate specific functionality is provided to suppress temperature elevation in the non-sheet contact areas.

Japanese Laid-Open Patent Application No. HEI 8-87191 discloses an example wherein a heat-moving roller has a small diameter area corresponding to the normal sheet contact area, and a large diameter area corresponding to the sheet non-contact area (FIG. 10A).

The heat-moving roller of the aforesaid disclosure, however, is disadvantageous when intermediate size sheets having a width larger than a minimum size and smaller than a maximum size are continuously fed insofar as the ends of the heating roller are subject to temperature reduction in the region of overlap between the large diameter area of the heat-moving roller and the intermediate size sheet, such that excellent fixing characteristics cannot be obtained.

SUMMARY OF THE INVENTION

An object of the present invention is to eliminate the previously mentioned disadvantages of the conventional art.

Another object of the present invention is to provide a fixing device capable of realizing stable fixing characteristics regardless of the sheet mode, and without temperature irregularities, in a direction perpendicular to the sheet transport direction by suppressing the temperature elevation in the sheet non-contact area of the rotatable heating member by constructing the heat-moving member with suitable values for heat capacity and thermal conductivity.

The fixing device of the present invention attains these objects by providing a fixing device for fixing toner maintained on a recording medium to the recording medium by heating and fusing said toner, the fixing device comprising:

a rotatable heating member heated by a heat source;

a rotatable pressure member for pressing against the rotatable heating member;

a heat-moving member formed of material having excellent thermal conductivity characteristics and constructed so as to freely make contact with at least one rotatable member among the rotatable heating member and the rotatable pressure member; and drive means to move the heat-moving member between a contact positive and retracted position relative to at least one among the rotatable heating member and the rotatable pressure member, and wherein the heat-moving member changes either heat capacity or thermal conductivity or both heat capacity and thermal conductivity relative to the axial direction of one of the rotatable heating member and rotatable pressure member.

The fixing device of the present invention further attains these objects by providing such fixing device for fixing toner maintained on a recording medium wherein the heat-moving member has a sheet contact area and a sheet non-contact area, a width of the sheet contact area corresponds to a minimum sheet length of the recording sheet, and a thickness of a material forming the heat-moving member in the sheet non-contact area is greater than a thickness of the material in the sheet contact-area.

The invention itself, together with further objects and attendant advantages, will be understood by reference to the following detailed description taken in conjunction with the accompanying drawings.

BRIEF DESCRIPTION OF THE DRAWINGS

FIG. 3(A) shows the temperature of the sheet contact area, FIG. 3(B) shows the temperature of the sheet non-contact area when the heat-moving member of the present embodiment is used, FIG. 3(C) shows the temperature of the sheet non-contact when using a heat-moving member of a comparison example having constant heat capacity along the axial direction, and FIG. 3(D) shows the temperature of the sheet non-contact area when a heat-moving roller is not provided;

FIG. 10(C) is a graph showing the axial direction distribution of the heating roller surface temperature when intermediate size sheets are continuously fed using the heat-moving roller shown in FIGS. 10(A) and 10(B);

In the following description, like parts are designated by like reference numbers throughout the several drawings.

DETAILED DESCRIPTION OF THE PREFERRED EMBODIMENTS

The preferred embodiments of the present invention are described hereinafter with reference to the accompanying drawings.

First Embodiment

Figure 1A:
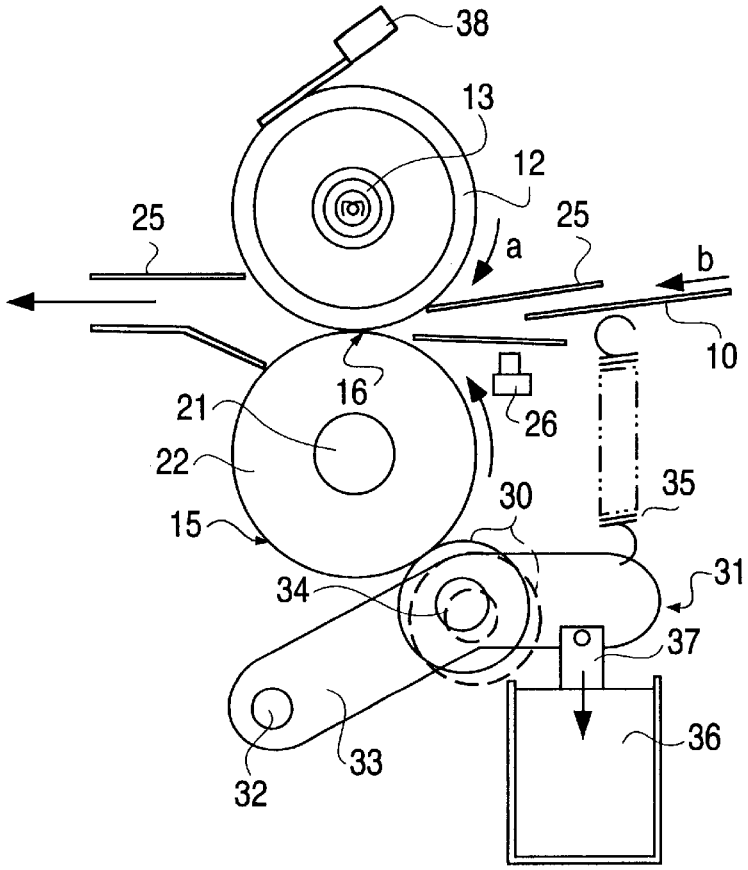
FIG. 1(A) briefly shows the construction of a fixing device of an embodiment of the present invention.
Figure 1B:
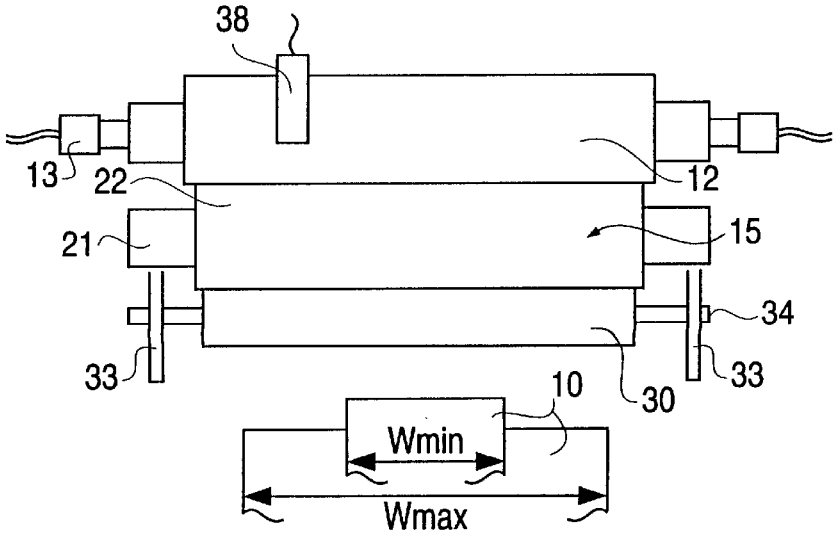
FIG. 1(B) is a plan view illustrating the arrangement of the heating roller, pressure roller, and heat-moving roller functioning as a heat-moving member.

FIG. 1(A) briefly shows the construction of the fixing device of a first embodiment of the present invention, and FIG. 1(B) is a plan view showing the arrangement of the heating roller, pressure roller, and heat-moving roller functioning as a heat-moving member.

The fixing device shown in the drawing heats and melts toner maintained on the surface of a sheet 10 functioning as a recording medium and fixes the toner on the sheet, and is provided with a heating roller (equivalent to a rotatable heating member) 12 heated by a heating source 13, and pressure roller (equivalent to a rotatable pressure member) 15 which presses against said heating roller 12. The heating roller 12 is disposed so as to be capable of being drivably rotated in the arrow "a" direction is FIG. 1(A), and pressure roller 15 is driven in rotation in conjunction with the rotation of heating roller 12.

Heating roller 12 is configured as a hollow tube with heating source 13 arranged on its center axis. Heating source 13 is constructed as a tube-like heat-generating heater such as, for example, a halogen lamp or the like, which generates heat when a predetermined voltage is applied thereto. Halogen lamp 13 is positioned on the center axis of heating roller 12, such that heat generated by halogen lamp 13 uniformly radiates along the width of the interior wall of heating roller 12, to achieve a uniform temperature distribution in the circumferential direction on the exterior wall of heating roller 12. The exterior wall of heating roller 12 is heated to a temperature (e.g., 150~200° C.) suitable for fixing.

Heating roller 12 is a metal roller formed of metal material having excellent thermal conductivity such as aluminum or the like, and this metal roller is formed so as to have a thin wall construction to reduce the heat capacity within a range capable of assuring adequate mechanical strength relative to the pressure contact force exerted by the pressure roller. The exterior surface of the metal roller is coated with a fluororesin coating as a separation layer having excellent toner separation characteristics and heat resistance characteristics to facilitate separation of recording sheet 10.

Slide bearings (not illustrated) are provided at bilateral ends of the heating roller 12, such that the roller is freely rotatable when mounted on the frame of a fixing unit (not illustrated). Heating roller 12 is provided with a drive gear (not illustrated) fixedly mounted on one end thereof, the drive gear being rotated by drive source (not illustrated) such as a motor connected to the drive gear.

The aforesaid pressure roller 15 comprises a core 21, and silicone rubber layer 22 formed on the exterior of the core 21. The silicone rubber layer 22 is a rubber layer having heat resistance characteristics and separation characteristics to facilitate separation of recording sheet 10 from the surface thereof. Pressure roller 15 is pressed against heating roller 12 via a spring member not shown in the drawing.

The recording sheet 10 bearing unfixed toner is transported from the right in FIG. 1(A) in the arrow "b" direction to nip 16 at the contact area between heating roller 12 and pressure roller 15. Sheet 10 is gripped and transported at the nip 16 so as to receive heat from the heated heating roller 12 and pressure from the pressure force applied by pressure roller 15. This heat and pressure fuses the unfixed toner image on the sheet 10, to form a fixed toner image on sheet 10. The toner is maintained on the side of sheet 10 which comes into contact with the heating roller 12. The sheet 10 which has passed through the nip 16, forms a natural curve so as to separate from heating roller 12 via the stiffness of the sheet itself, and is transported to the left in FIG. 1(A). Sheet 10 is then transported by a discharge roller (not illustrated), and ejected to a discharge tray. A plurality of guide panels 25 are mounted on the fixing device to form the transport path feeding to the nip area 16 and a transport path from the nip area 16 to the ejection area. A paper sensor 26 is provided at a position upstream from the nip area 16 along the sheet transport direction to detect the passage of sheet 10.

This fixing device is provided with a heat-moving roller (equivalent to a heat-moving member) 30 formed of a material having excellent heat conductivity characteristics and disposed so as to abut at least one roller among heating roller 12 and pressure roller 15, and a drive means 31 to move the heat-moving member 30 between a position at which the heat-moving member 30 is pressed against at least one roller among the heating roller 12 and the pressure roller 15 and a position retracted from the contact.

In a first embodiment of the heat-moving roller 30, the heat-moving roller 30 abuts the pressure roller 15, such that the heat of heating roller 12 migrates through pressure roller 15 to heat-moving roller 30. Control of the temperature rise of the sheet non-contact areas of heating roller 12 is not impaired even though the heat migrates through pressure roller 15 to heat-moving roller 30 since responsiveness is not an issue. Heat-moving roller 30 is a metal roller formed of a material having excellent heat conductivity such as aluminum, copper or the like, and has a length equal to the length in the axial direction of the pressure roller 15. The axial center of heat-moving roller 30 is arranged parallel to the axial center of pressure roller 15, such that heat-moving roller 30 abuts pressure roller 15 uniformly along the axial direction.

The aforesaid drive means 31 is provided with a pair of support panels 33 mounted on the fixing unit frame so as to be freely pivotable about a pin 32 provided on the base edge, such that the support panels 33 support the shaft 34 of heat-moving roller 30 so as to be freely rotatable. A tension coil spring 35 is provided between the leading edge of support panel 33 and the fixing unit frame to exert force in a direction to bring heat-moving roller 30 into contact with pressure roller 15. Connected to the leading edge of support panel 33 is a rod 37 of solenoid 36 which pivots the support panel 33. When solenoid 36 is turned ON, rod 37 moves in an upward direction in the drawing, such that heat-moving roller 30 is moved with the force of spring 35 to the contact position and presses against pressure roller 15. On the other hand, when solenoid 36 is turned OFF, rod 37 moves in a downward direction in the drawing, such that heat-moving roller 30 is moved against the force of spring 35 to the retracted position and separates from pressure roller 15. In FIG. 1(A), the solid line represents the position of heat-moving roller 30 at the contact position, and the broken line represents the position of heat-moving roller 30 at the retracted position.

If a position adjustment mechanism is provided to freely change the position of solenoid 36, the pressure contact force of the heat-moving roller 30 relative to the pressure roller 15 may be freely varied. Such a position adjustment mechanism may comprise a motor and slider or the like. When such a construction is used, the width of the position of mutual contact between pressure roller 15 and the heat-moving roller 30 can be varied in accordance with the pressure contact force, such that the amount of heat migrating from the heating roller 12 to the heat-moving roller 30 may be changed. Accordingly, the control of the temperature rise of the sheet non-contact areas can be finely adjusted if the pressure contact force of the heat-moving roller 30 is modifiable in accordance with the degree of temperature change of the sheet non-contact areas of the heating roller 12.

Drive means 31 is not limited to the example shown in the drawing, and may be modified as suitable. For example, a compression coil spring may be provided on the underside of the support panel in the drawing, and a solenoid may be provided on the upper side of the support panel in the drawing.

Figure 2:
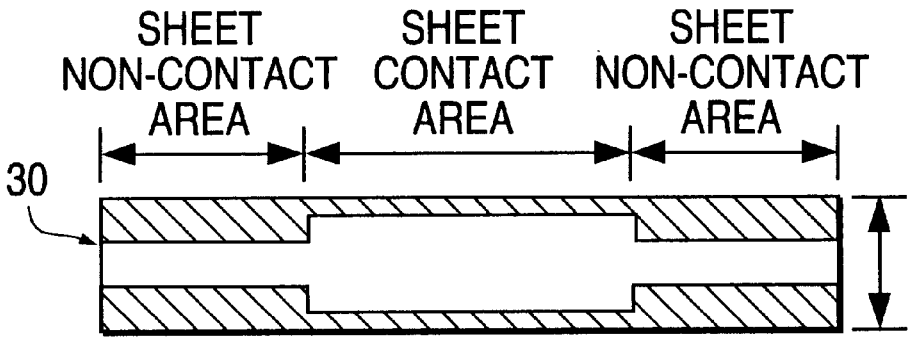
FIG. 2 is a section view of the heat-moving roller.

FIG. 2 is a section view showing the heat-moving roller 30.

In the heat-moving roller 30 of the first embodiment, the thermal capacity is changed relative to the axial direction of either the heating roller 12 or pressure roller 15. That is, the heat-moving roller 30 is formed such that the thickness of the material forming the heat-moving roller 30 in the non-contact areas at which the small size sheet normally does not pass is a width corresponding to the width dimension of the small size sheet and is thicker than the thickness of the material forming the heat-moving roller 30 in the contact area at which a small size sheet does pass, and the cross section area (see FIG. 2) changes to increase the heat capacity of the sheet non-contact areas relative to the normal sheet contact areas. The heat absorption capability of the sheet non-contact area and the normal sheet contact area can be changed by changing the heat capacity, such that the heat absorption capability of the thicker sheet non-contact area is greater than that of the sheet contact area.

Since the heat absorption capability of the sheet non-contact area of the heat-moving roller 30 can be made greater than the heat absorption capability of the sheet contact area by changing its heat capacity, the heat of the sheet non-contact areas of the heating roller 12 and pressure roller 15 migrate sufficiently to suppress the temperature rise of the sheet non-contact areas, and the halogen lamp 13 used as a heat source need not supply heat in excess of requirements due to the reduced heat absorption capability of the normal sheet contact area. In this instance, since the supply of heat to the sheet non-contact area also is simultaneously reduced, a result is that it is possible to markedly suppress the temperature rise of the sheet non-contact area. Furthermore, the power consumed by the halogen lamp 13 also is reduced, thereby reducing power consumption of the device.

In the fixing device shown in the drawings, the sheet non-contact area is distributed laterally in the drawing such that the center of transport of sheets of different sizes is at a fixed position. In contrast, the sheet non-contact areas may be made thicker only at positions on the left side of the normal sheet contact area, for example, when different size sheets are transported with the right edge of said sheet standardized at the right edge in FIG. 1(B).

Figure 3:
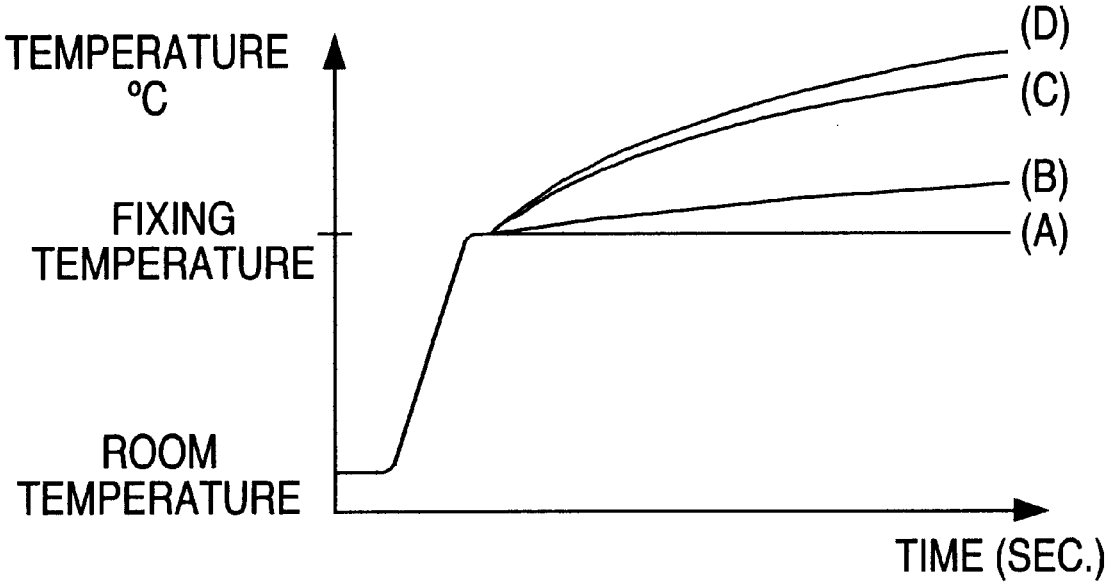
FIG. 3 is a graph showing the transition of the heating roller surface temperature when small size sheets are continuously fed.

FIG. 3 is a graph showing the transition of the heating roller surface temperature when small size sheets are continuously transported; A) shows temperature verses time of the sheet contact area, B) shows the temperature verses time of the sheet non-contact area when the heat-moving member of the present embodiment is used, 3(C) shows the temperature verses time of the sheet non-contact area when using a heat-moving member of a comparison example having constant heat capacity along the axial direction, and D) shows the temperature verses time of the sheet non-contact area when a heat-moving roller is not provided.

Since the heat capacity along the axial direction is constant in the case of (C) using a heat-moving member of a comparison example, there is insufficient migration of the heat of the sheet non-contact area of heating roller 12 to the heat-moving roller . Therefore, the temperature of the sheet non-contact area rises over time, such that the temperature difference with the normal sheet contact area temperature (A) is similar to that of (D) in which a heat-moving roller is not used, and the temperature difference tolerance (e.g., ±10° C.) is exceeded.

In contrast, in case (B) of the first embodiment, since the heat absorption capability of the sheet non-contact area is increased by changing the heat capacity along the axial direction of the heat-moving roller 30, the heat of the sheet non-contact area migrates sufficiently to the heat-moving member, thereby markedly reducing the temperature rise of the sheet non-contact area and suppressing the temperature difference between the sheet contact and non-contact areas of the roller to within the allowed temperature difference range.

This fixing device is provided with a first temperature sensing means 38 to detect the temperature of at least one roller among the heating roller 12 and the pressure roller 15. The temperature sensing means may be a thermistor or the like, so as to detect the temperature of the heating roller, for example; the first thermistor 38 is provided so as to be in contact with the exterior surface of heating roller 12. The first thermistor 38 is disposed to the outside of a minimum sheet width Wmin pursuant to a known minimum sheet width Wmin of the sheet 10 in the fixing device (e.g., the width dimension of a B5 sheet) and the maximum width Wmax (e.g., the length dimension of an A4 sheet). This area corresponds to a location at which it is necessary to suppress a temperature rise, and temperature rise of the sheet non-contact area can be accurately suppressed by measuring the temperature of this location. Solenoid 36 is turned ON/OFF based on the temperature of the heating roller 12 detected by thermistor 38 disposed as described above.

Figure 4:
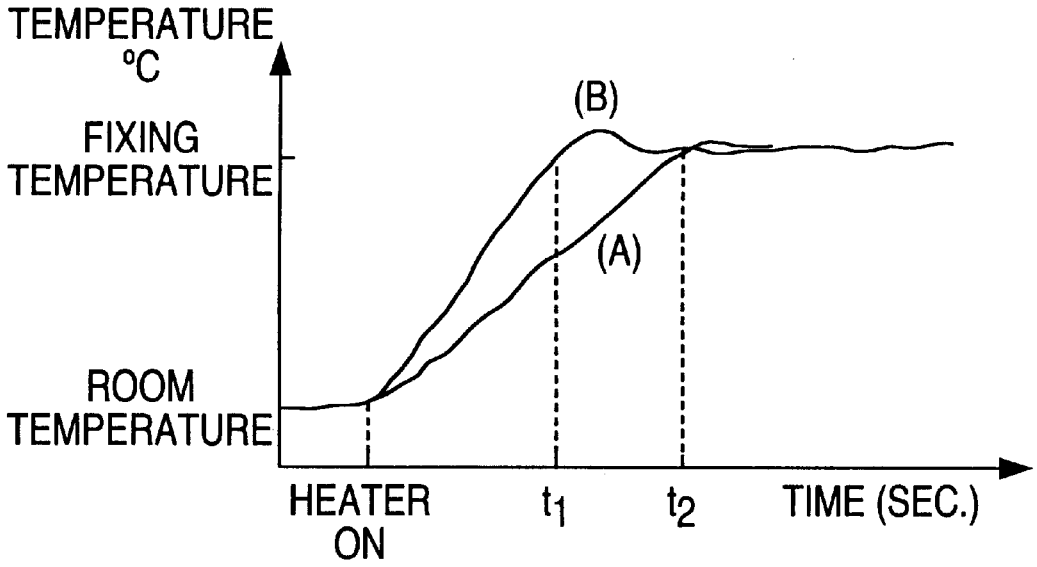
FIG. 4 is a graph showing the temperature rise characteristics of the heating roller.

FIG. 4 is a graph showing the temperature rise characteristics of the heating roller 12; (A) shows the temperature rise characteristics when the warm up has been accomplished with the heat-moving roller 30 in a state of contact with the pressure roller 15, and (B) shows the temperature rise characteristics when warm up has been accomplished with heat-moving roller 30 retracted from the pressure roller 15.

When warm up is accomplished with the heat-moving roller 30 in a state of contact with the pressure roller 15, the heat generated by the halogen lamp 13 passes through heating roller 12 and pressure roller 15 and is absorbed by the heat-moving roller 30. As shown in the drawing, therefore, the standby end time t2 at which the surface temperature of the heating roller 12 has attained a predetermined fixing temperature is longer than the standby end time t1 when warm up is accomplished with the heat-moving roller 30 retracted from the pressure roller 15.

In the first embodiment, the heat-moving roller 30 is maintained at the retracted position during the warm up time until an initial sheet 10 reaches the nip area 16. Therefore, there is no loss of the advantage of reduced warm up time achieved by making the heating roller 12 thinner even when a heat-moving roller 30 is provided.

Figure 5:
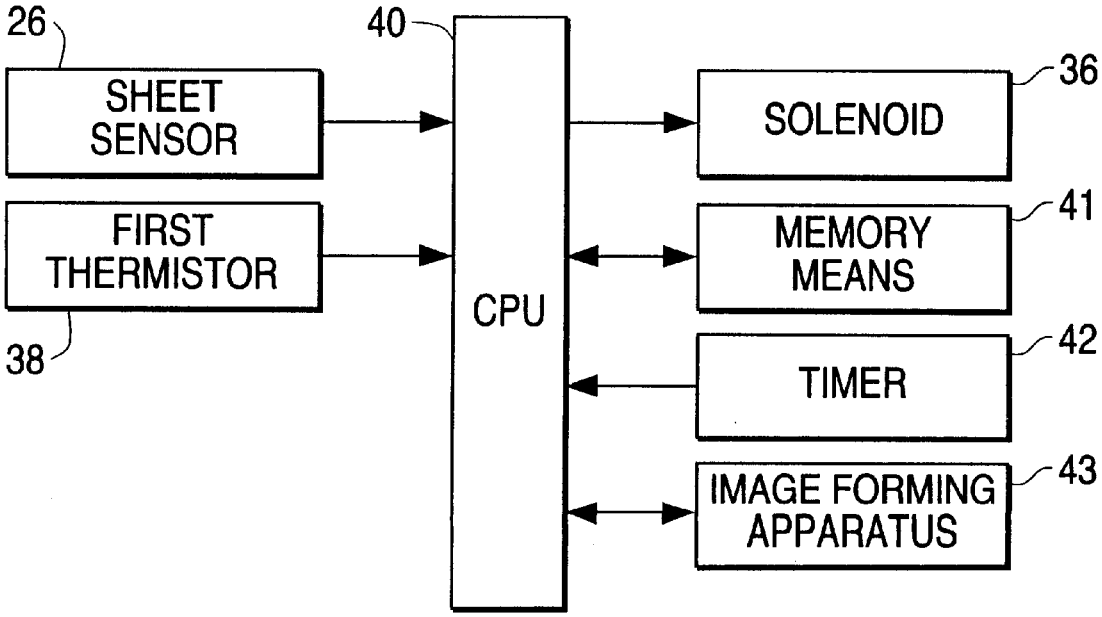
FIG. 5 is a block diagram of the control system of the fixing device.

FIG. 5 is a brief block diagram showing the control system of the fixing device.

A central processing unit (CPU) 40 is provided as a control means, and a sheet sensor 26, first thermistor 38, and solenoid 36 and the like are connected thereto, such that information relating to the presence of a sheet and the temperature of the heating roller 12 is input to CPU 40, and control signals to turn ON/OFF solenoid 36 are output from CPU 40. CPU 40 is connected to a memory means 41 such as a read only memory (ROM) or random access memory (RAM), and a timer 42, and programs (described later) executed by CPU 40 are stored in ROM. CPU 40 also is connected to an image forming apparatus 43 such as a copier or the like incorporating the fixing device, and information not set in the image forming apparatus 43 such as detected sheet size, printing mode (continuous feed mode or the like), number of print sheets and the like is input to CPU 40.

Figure 6:
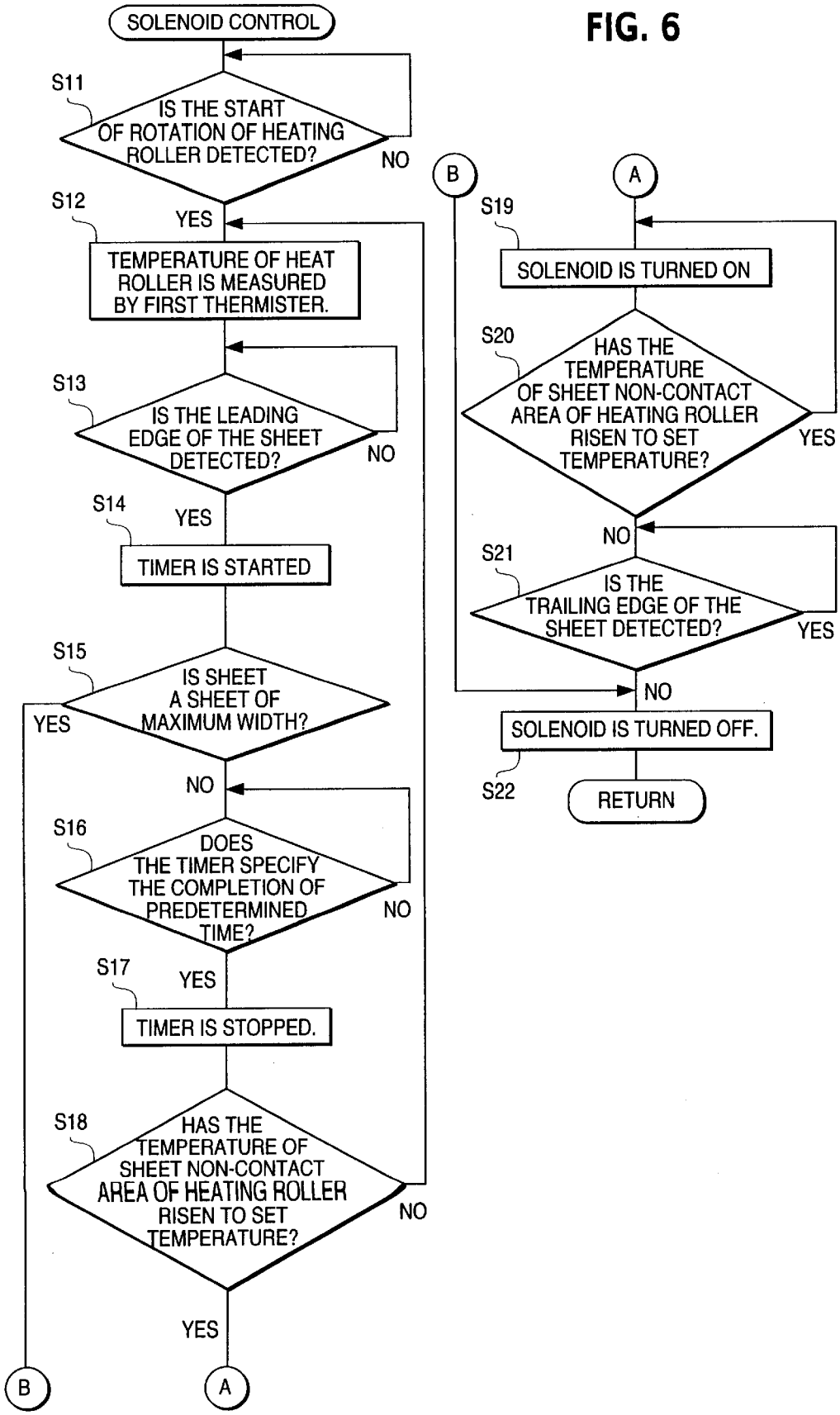
FIG. 6 is a flow chart showing the control routine of the solenoid provided in the fixing device.

The operation of the first embodiment is described below with reference to the flow chart of FIG. 6. FIG. 6 is a flow chart showing the control routine for the solenoid provided in the fixing device.

When the control routine starts, solenoid 36 is turned OFF, and heat-moving roller 30 is moved to the retracted position. When the start of rotation of heating roller 12 is detected in step S11, the temperature of the area outside the minimum sheet width Wmin of heating roller 12 is measured by thermistor 38 (S12). When the leading edge of the sheet 10 is detected based on the output from sheet sensor 26 via the passage of sheet 10 (S13), the timer 42 is started (S14).

CPU 40 determines whether or not a transported sheet 10 is a maximum width sheet based on the information relating to sheet size received from the image forming apparatus (S15).

When sheet 10 is a sheet of maximum sheet width (S15: YES), the routine advances to step S22 because there is no need to suppress the temperature rise of the sheet non-contact areas of the heating roller 12, and the routine returns to the main flow (not illustrated) with the solenoid 36 remaining turned OFF.

On the other hand, when the sheet 10 is not a sheet of maximum width (S15: NO), the routine advances to step S16 because there is a necessity to suppress the temperature rise of the sheet non-contact area of the heating roller 12. When timer 42 specifies the completion of a predetermined time to stabilize the temperature of the heating roller 12 and sheet 10 (S16), the timer 42 is stopped (S17), and a determination is made as to whether or not the temperature of the area outside the sheet minimum width, i.e., the sheet non-contact area, of heating roller 12 is equal to or greater than a set temperature (S18).

When the temperature of the sheet non-contact area has not risen to the set temperature (S18: NO), the routine returns to step S12, and the previously described process is repeated (S12~S18).

On the other hand, when the temperature of the sheet non-contact area of the heating roller 12 has risen to a set temperature (S18: YES), solenoid 26 is turned ON, and the heat-moving roller 30 is moved to the contact position (S19). Heat-moving roller 30 is rotated in contact with the pressure roller 15, and the heat of heating roller 12, and particularly the heat of the sheet non-contact areas, passes through pressure roller 15 to the heat-moving roller 30. Therefore, the temperature rise of the sheet non-contact area is suppressed even when using modes of continuous feeding of small size sheets smaller than the maximum sheet width, and the temperature difference between the temperature of the sheet contact area of the heating roller 12 and the temperature of the sheet non-contact area is reduced. The result of suppressing irregular temperature of the heating roller 12 is preventing thermal damage and reduction of the heat resistance service life of peripheral components. Furthermore, since a uniform heat distribution is maintained along a direction perpendicular to the sheet transport direction, local fixing irregularities do not occur and high temperature offset is prevented even when a large size recording sheet is fed directly after the aforesaid mode.

While the temperature of the sheet non-contact area of the heating roller 12 is at or above a set temperature (S20: YES), the heat-moving roller 30 is held at the contact position to suppress the temperature rise of the sheet non-contact area as previously described (S19, S20).

When the temperature of the sheet non-contact area of heating roller 12 falls below a set temperature (S20: NO) and the trailing edge of the sheet 10 is detected based on the output from sheet sensor 26 (S21), solenoid 26 is turned OFF after a preset time has elapsed and heat-moving roller 30 is moved to the retracted position (S22).

Heat-moving roller 30 is not immediately retracted even when the temperature of the sheet non-contact area is less than a set temperature, but rather the heat-moving roller 30 is retracted from the pressure roller 15 starting when the fixing process has completed and the sheet 10 is not at the nip area 16. Therefore, the thermal shock accompanying the retraction of the heat-moving roller 30 does not act on the heating roller 12 and image noise is not present in the fixed image.

For similar reasons it is desirable that heat-moving roller 30 starts to make contact with the pressure roller 15 when the sheet 10 is not at the nip 16. Thus, heat-moving roller 30 does not immediately make contact with pressure roller 15 even after the temperature of the sheet non-contact area exceeds the upper limit temperature during a fixing process of a transported sheet 10, but rather the heat-moving roller 30 is controlled so as to make contact with pressure roller 15 after the aforesaid fixing process is completed for the sheet 10, but before a next sheet 10 is transported to the nip 16.

Second Embodiment

Figure 7A:
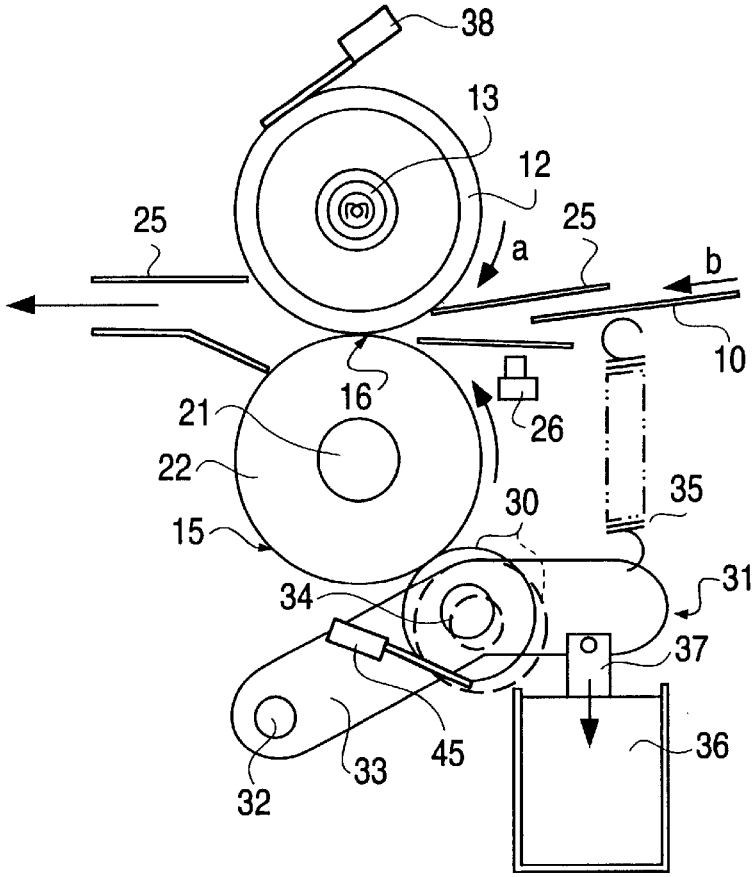
FIG. 7(A) briefly shows the construction of the fixing device of a second embodiment.
Figure 7B:
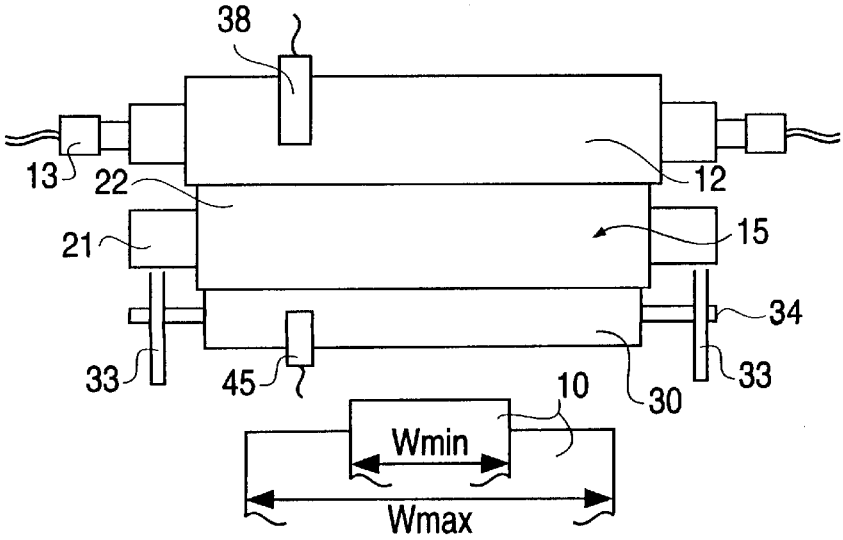
FIG. 7(B) is a plan view showing the arrangement of the heating roller, pressure roller, and heat-moving roller functioning as a heat-moving member.

FIG. 7(A) briefly shows the construction of the fixing device of a second embodiment, and FIG. 7(B) is a plan view showing the arrangement of the heating roller, pressure roller, and heat-moving roller; parts common with those of FIG. 1 are identified by identical reference numbers and are not discussed further.

The fixing device of the second embodiment is provided with a second temperature detection means 45 to detect the temperature of the heat-moving roller 30. The temperature detection means comprises a thermistor or the like, with the second thermistor 45 being disposed so as to abut the exterior surface of the heat-moving roller 30.

The second thermistor 45 is arranged outside the maximum sheet width Wmax in the same manner as the first thermistor 38. This area corresponds to a location at which temperature rise must be suppressed. In the second embodiment, solenoid 36 is turned ON/OFF based on the temperature of the heat-moving roller 30 detected by the second thermistor 45 and the temperature of the heating roller 12 detected by the first thermistor 38.

Figure 8:
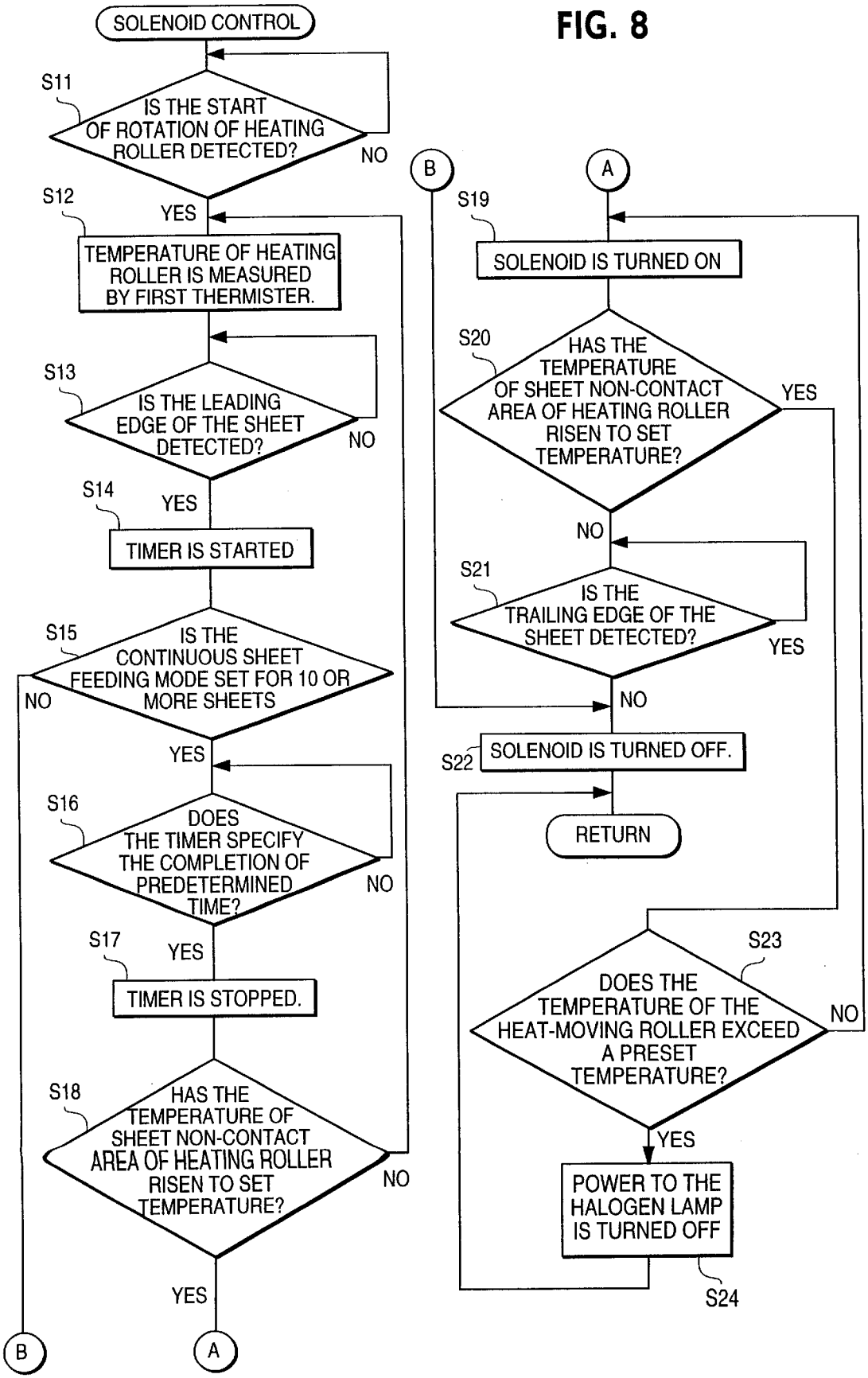
FIG. 8 is a flow chart of the control routine of the solenoid in the second embodiment.

FIG. 8 is a flow chart showing the control routine of the solenoid in the second embodiment; processes common with the first embodiment are labeled by the same step numbers and are not discussed further.

In the second embodiment, CPU 40 determines whether or not the continuous sheet feeding mode is for 10 or more sheets based on the information relating to the number of print sheets and the print mode (whether or not the continuous print mode is set) received from the image forming apparatus (S15*a*).

When the continuous print mode is not for 10 or more sheets (S15*a*: NO), there is no need to suppress the temperature rise of the sheet non-contact area of heating roller 12 since the temperature of the heating roller 12 cannot rise to that degree, and the routine advances to step S22, and returns to the main flow with the solenoid 36 remaining turned OFF.

On the other hand, when the continuous sheet feeding mode is set for 10 or more sheets (S15*a*: YES), the processes of steps S16~S18 are executed because the temperature rise of the sheet non-contact area of heating roller 12 must be suppressed.

When the result of the determination as to whether or not the temperature of the sheet non-contact area of heating roller 12 has risen above a preset temperature is that the preset temperature has been exceeded (S18: YES), solenoid 36 is turned ON, and the heat-moving roller 30 is moved to the contact position (S19). The heat-moving roller 30 is brought into contact with the pressure roller 15, and the heat of the heating roller, and particularly the heat of the sheet non-contact area of the heating roller passes through the pressure roller 15 to the heat-moving roller 30. Therefore, the temperature rise of the sheet non-contact area is suppressed as is temperature irregularities of the heating roller 12, thereby avoiding thermal damage and reduction of heat resistance service life of peripheral components. Furthermore, local fixing irregularities do not occur and high temperature offset is prevented.

During the time the temperature of the sheet non-contact area of heating roller 12 exceeds the preset temperature (S20: YES), a determination is made as to whether or not the temperature of the heat-moving roller 30 exceeds a preset temperature (S23), and if the temperature of the heat-moving roller 30 is less than said preset temperature (S23: NO), the heat-moving roller 30 is held at the contact position to suppress the temperature rise of the sheet non-contact area as described above (S19, S20, S23).

On the other hand, when the sheet non-contact area of heating roller 12 exceeds the preset temperature and the temperature of the heat-moving roller 30 also exceeds a preset temperature (S23: YES), power to the halogen lamp 13 is temporarily turned OFF and operation of the fixing device is stopped due to possible abnormal heating of the heating roller 12 should there be some impairment of the power flow control to the halogen lamp 13 (S24). Therefore, damage to the fixing device is prevented before it occurs.

Since the series of image formation processes is interrupted in accordance with the stopping of the fixing device, the sheet 10 being transported at this time is ejected, and image forming processes are restarted after a predetermined time period has elapsed, and a display indicating that the fixing device should be inspected is displayed on the control panel or the like of the image forming apparatus.

Third Embodiment

Figure 9:
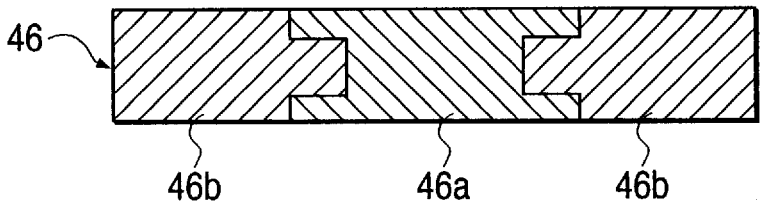
FIG. 9 is a section view of the heat-moving roller of a third embodiment.

FIG. 9 is a section view of a heat-moving roller of a third embodiment.

The heat-moving roller of the third embodiment differs from the heat-moving roller of the first embodiment in that the heat absorption capability of the sheet non-contact area has a specifically modified construction relative to the sheet contact area. That is, the thickness of the sheet contact area and the thickness of the sheet non-contact area are changed in the first embodiment to change the heat capacity in the axial direction, whereas heat absorption capability of the sheet non-contact area is increased in the third embodiment by changing the thermal conductivities of the sheet contact area and the sheet non-contact area.

As shown in FIG. 9, the heat-moving roller 46 comprises a first roller 46*a* disposed in the sheet contact area, and a second roller 46*b* disposed in the sheet non-contact areas at the bilateral ends of said first roller 46*a*, and the thermal conductivity of the second roller 46*b* is greater than the thermal conductivity of the first roller 46*a* so as to increase the heat absorption capability of the sheet non-contact area relative to the sheet contact area. The second roller 46*b* of the sheet non-contact area is desirably formed of a material having excellent thermal conductivity, for example, aluminum, copper or alloys thereof. The first roller 46*a* of the sheet contact area is desirably formed of material such as stainless steel or the like.

The heat-moving roller 46 can be smoothly brought into contact with an opposing pressure roller 15 or heating roller 12 so as to achieve more suitable temperature control by integratedly constructing the first and second rollers 46*a* and 46*b* via friction, insertion or the like.

Since the heat-moving roller 46 of the third embodiment increases the heat absorption capability of the sheet non-contact area by changing the thermal conductivity along the axial direction of the heat-moving roller 46, the heat of the sheet non-contact area of the heating roller 12 sufficiently migrates to the heat-moving roller 46, thereby greatly reducing the temperature rise of the sheet non-contact area and suppressing the temperature difference between the sheet contact area and the sheet non-contact area to within an allowed range.

Figure 10A:
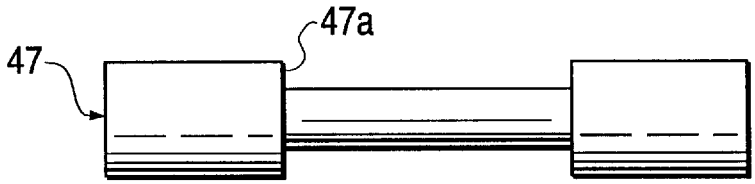
FIGS. 10(A) and 10(B) are conceptual drawings showing the sheet non-contact area of a conventional heat-moving roller.

FIG. 10(A) is a conceptual diagram showing the sheet non-contact area of a conventional heat-moving roller.

Figure 10B:
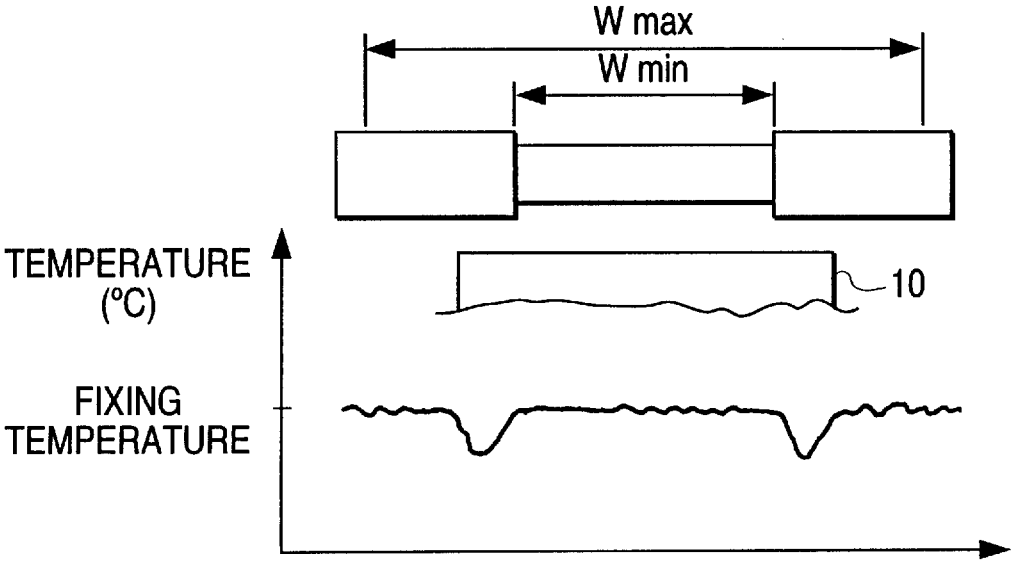

This heat-moving roller 47 has a small diameter part corresponding to the sheet contact area and large diameter parts corresponding to the sheet non-contact area. The construction of the heat-moving roller, as shown in FIG. 10(B), is disadvantageous in that it provides that when sheets 10 of an intermediate size, having a width larger than a minimum size and a width smaller than a maximum size, are continuously fed, the large diameter part of heat-moving roller 47 corresponds to the region of overlap with the intermediate size sheet 10, and an extreme temperature drop results in heating roller 12 such that excellent fixing characteristics cannot be obtained.

As shown in FIGS. 2 and 9, the heat-moving roller may be formed in a cylindrical shape without difference in levels (reference number 47*a* in FIG. 10A) between the sheet contact area and the sheet non-contact area, so as to make contact along the entire surface of the opposing pressure roller 15 or heating roller 12 in the axial direction. This construction is advantageous in that local temperature drop in heating roller 12 is suppressed when an intermediate size sheet 10 is transported.

Although either one or another of the heat capacity or thermal conductivity of the heat-moving roller are changed in the axial direction in the third embodiment and previously described first embodiment, it is to be understood that both heat capacity and thermal conductivity may be changed. For example, in the heat-moving roller 46 of the third embodiment, the first roller 46*a* may be hallow, and the cross section area of the first roller 46*a* and the second roller 46*b* may be changed.

Fourth Embodiment

Figure 11:
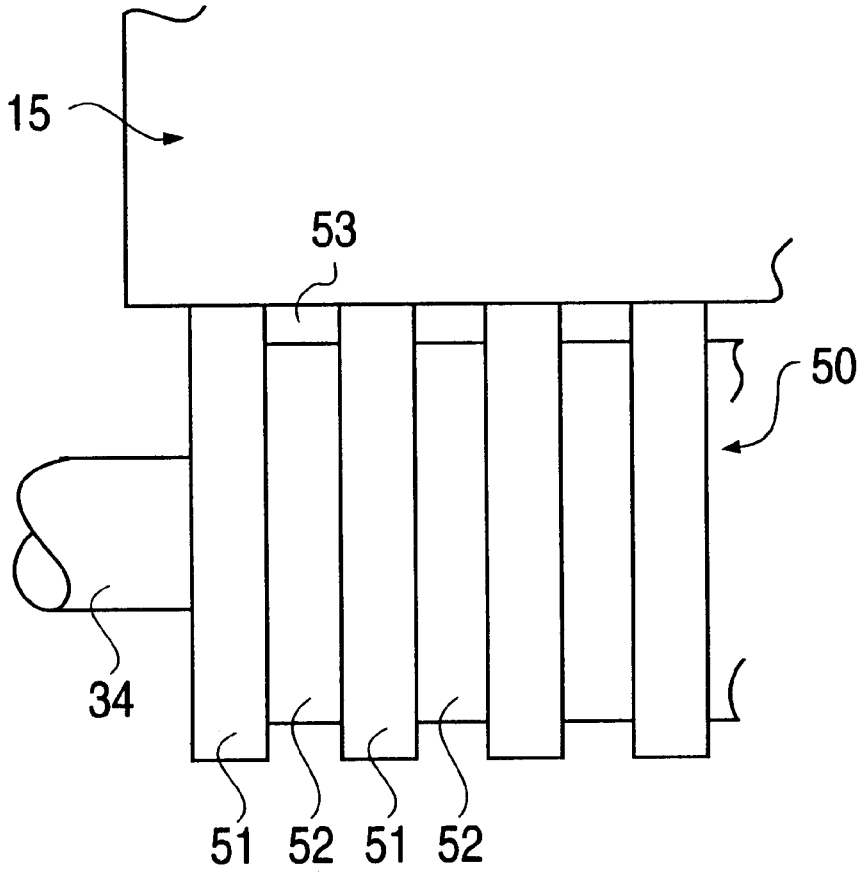
FIG. 11 is an enlarged plan view of the essential part of the heat-moving roller of a fourth embodiment.

FIG. 11 is a plan view showing an enlargement of the essential part of the heat-moving roller of a fourth embodiment used to control the temperature along the axial length of the pressure roller 15, or alternately, the heating roller.

Heat-moving roller 50 of the fourth embodiment is provided along the axial length with first and second divided rollers (each equivalent to half the heat-moving parts) 51 and 52 formed of at least two types of materials having different thermal expansibilities. The second divided roller 52 is formed of material having a thermal expansibility greater than the material used to form the first divided roller. The material having high thermal expansibility used to form the second divided roller 52 is specified as a material having a thermal expansibility of about $20\times10^{-6}$ 1/° C., specifically the second divided roller is formed of, for example, aluminum, copper, lead or the like. The material having a low thermal expansibility used to form the first divided roller 51 is specified as a material having a thermal expansibility of about $10\times10^{-6}$ 1/° C., specifically the first divided roller 51 is formed of, for example, stainless steel SUS 430 or the like.

The first divided roller 51 of low thermal expansibility is formed with a large diameter, and the second divided roller 52 of high thermal expansibility is formed with a small diameter such that the heat-moving roller 50 comprises the first and second divided rollers 51 and 52 assembled on a mutual support shaft 34. The beginning of movement of the heat-moving roller 50 to the contact position on the one hand bring the large diameter first divided roller 51 into contact with the pressure roller 15, and forms a small gap 53 between the small diameter second divided roller 52 and the pressure roller 15.

In the heat-moving roller 50 of the aforesaid construction, only the large diameter first divided roller 51 having a low thermal expansibility is pressed against the pressure roller 15 when the temperature of the heating roller 12 is relatively low. Therefore, a relatively small amount of heat migrates from the heating roller 12 through the pressure roller 15 to the heat-moving roller 50 and a rise in the temperature of the heating roller 12 is not prevented.

On the other hand, when the temperature of heating roller 12 is relatively high, the small diameter second divided roller 52 having a high thermal expansibility expands so as to come into contact with the pressure roller 15 and increase the contact area of the heat-moving roller 50 with the pressure roller 15. Therefore, a relatively large amount of heat migrates from the heating roller 12 through the pressure roller 15 to the heat-moving roller 50, thereby suitably suppressing the temperature rise in the heating roller 12 as well as temperature irregularities of the heating roller 12. As a result, peripheral components are not subject to thermal damage or reduced heat resistance service life, local irregularities of fixing characteristics are prevented as is high temperature offset.

In the fourth embodiment, the first and second divided rollers 51 and 52 (each equivalent to half the heat-moving parts) are provided in both the sheet contact and sheet non-contact areas of the heat-moving roller 50 to control temperature along the axial length of the pressure roller 15 substantially equally. In another configuration of the fourth embodiment, a single roller is provided in the sheet contact area and first and second divided rollers 51 and 52 are provided in the sheet non-contact area (each equivalent to half the heat-moving parts of the sheet non-contact area) to control temperature along the axial length of the pressure roller 15 in a manner similar to that of the first embodiment. The roller provided in the sheet contact area has a diameter equal to the diameter of the first divided roller and is formed of the same material as the first divided roller 51.

Fifth Embodiment

Figure 12A:
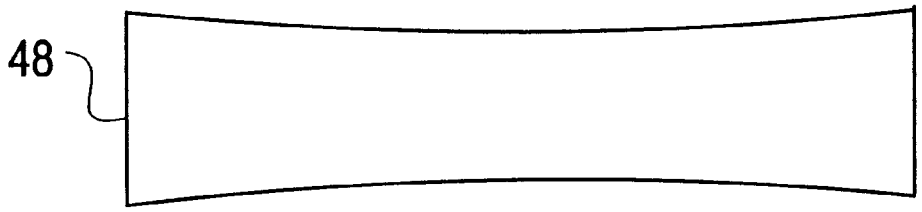
FIG. 12(A) is a front view of a heat-moving roller used in a fixing device of a fifth embodiment.
Figure 12B:
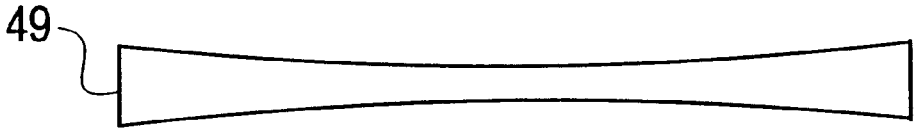
FIG. 12(B) shows the nip shape formed between said heat-moving roller and the pressure roller.

FIG. 12(A) is a front view of a heat-moving roller used in a fixing device of a fifth embodiment, and FIG. 12(B) shows the shape of the nip area formed between said heat-moving roller and the pressure roller. The fifth embodiment differs from the first embodiment in that the shape of the heat-moving roller is modified. The general construction of the fixing device is identical to that shown in FIG. 1, and is therefore not discussed further.

Similar to the first embodiment, the fixing device of the fifth embodiment is provided with a heating roller 12 heated by a halogen lamp 13, pressure roller 15 which presses against the heating roller 12, heat-moving roller 48 which functions as a heat-moving member comprised of material having excellent heat conduction characteristics, and a drive means 31 to move said heat-moving roller 48 between a contact position and a retracted position relative to at least one roller among said heating roller 12 and pressure roller 15. Pressure roller 15 comprises a layer of a flexible material such as, for example, silicone rubber layer 22 formed on the surface of a shaft 21.

Particularly in the present fifth embodiment, the heat-moving roller 48 is constructed so as to freely contact the pressure roller 15 having a surface layer of a flexible material among the heating roller 12 and pressure roller 15, and the shape of the nip formed when said heat-moving roller 48 contact said pressure roller 15 changes relative to the axial direction.

Specifically, as is exaggeratedly illustrated in FIG. 12(A), the heat-moving roller 48 forms an inverse crown shape as the diameter gradually increases toward bilateral ends from a center position along the axial direction. Since the center of rotation of the heat-moving roller 48 and the center of rotation of the pressure roller 15 are mutually parallel, when the heat-moving roller 48 is moved to the contact position, the width (i.e., length in the direction of rotation) of the nip formed between said heat-moving roller 48 and the pressure roller 15 changes so as to become larger toward bilateral ends in the axial direction of heat-moving roller 48 and pressure roller 15.

There is adequate thermal migration to the heat-moving roller 48 when the temperature of the sheet non-contact area becomes elevated because the pressure roller 15 which has a surface constructed of flexible material and the heat-moving roller 48 make interfacial contact such that the unit contact area in the circumferential direction increases the sheet non-contact area more than the sheet contact area. Moreover, the heat migration from the sheet contact area to the heat-moving roller 48 is suppressed so as to conserve energy consumption by the halogen lamp 13, and suppress the temperature rise of the sheet non-contact area.

The heat-moving roller 48 is formed of an identical material along the axial direction, such that the heat-moving roller 48 has different heat capacities in the sheet contact area and the sheet non-contact area because the nip width changes in the axial direction even when pressed against the pressure roller 15 with an identical pressure force, thereby suppressing temperature rise in the sheet non-contact area.

Although fixing devices utilizing a halogen heat source has been described in each of the aforesaid embodiment, it is to be noted that the present invention is not limited to this heating method inasmuch as the present invention may be adapted to fixing devices utilizing, for example, an induction heating method. Furthermore, the rotatable heating member is not limited to a heating roller, and a thin sleeve type member having flexibility may be used.

There accordingly has been described a fixing device capable of realizing stable fixing characteristics regardless of the sheet mode and without temperature irregularities in a direction perpendicular to the sheet transport direction by suppressing the temperature elevation in the sheet non-contact area of the rotatable heating member by constructing the heat-moving member with suitable values for heat capacity and thermal conductivity.

The many features and advantages of the invention are apparent from the detailed specification, and thus, it is intended by the appended claims to cover all such features and advantages of the invention which fall within the true spirit and scope of the invention. Although the present invention has been fully described by way of examples with reference to the accompanying drawings, it is to be noted that various changes and modification will be apparent to those skilled in the art. Therefore, unless such changes and modifications depart from the scope of the present invention, they should be construed as being included therein.

What is claimed is:

1. A fixing device for fixing toner maintained on a recording sheet by heating and fusing the toner to the recording sheet, comprising:

a rotatable heating member heated by a heat source;

a rotatable pressure member for pressing against said rotatable heating member;

a heat-moving member formed of material having excellent thermal conductivity characteristics and constructed so as to freely make contact with at least one rotatable member among said rotatable heating member and said rotatable pressure member; and a drive means to move said heat-moving member between a contact position and a retracted position relative to said at least one rotatable member, said heat-moving member changing one of heat capacity and thermal conductivity relative to an axial direction of one of said rotatable heating member and said rotatable pressure member, said heat-moving member having different heat absorption capability characteristics along a longitudinal axis thereof.

2. The fixing device according to claim 1, wherein said heat-moving member has a sheet contact area and a sheet non-contact area corresponding to a sheet contact area and a sheet non-contact area of both of said rotatable heating member and said rotatable pressure member, a width of the sheet contact area corresponds to a minimum sheet length of the recording sheet, and a thickness of a material forming said heat-moving member in the sheet non-contact area is greater than a thickness of the material in the sheet contact-area.

3. The fixing device according to claim 2, further comprising a temperature sensor to detect a temperature of the non-contact area of at least one rotatable member among said rotatable heating member and said rotatable pressure member, wherein said drive means drives said heat-moving member to the contact position when a length of the recording sheet is less than a maximum sheet length and the detected temperature of the non-contact area is equal to or greater than a set temperature.

4. The fixing device according to claim 3, further comprising another temperature sensor to detect a temperature of the heat-moving member, wherein power to the heat source is cut off when the detected temperature of the non-contact area is greater than a set temperature and the detected temperature of the heat-moving member exceeds another set temperature.

5. The fixing device according to claim 1, wherein said heat-moving member has a sheet contact area and a sheet non-contact area corresponding to a sheet contact area and sheet non-contact area of said rotatable heating member and said rotatable pressure member, and said heat-moving member comprises a first roller corresponding to the sheet contact area and a second roller corresponding to the sheet non-contact area, thermal conductivity of said second roller is greater than thermal conductivity of the first roller.

6. The fixing device according to claim 5, further comprising a temperature sensor to detect a temperature of the non-contact area of at least one rotatable member among said rotatable heating member and said rotatable pressure member, wherein said drive means drives said heat-moving member to the contact position when a length of the recording sheet is less than a maximum sheet length and the detected temperature of the non-contact area is equal to or greater than a set temperature.

7. The fixing device according to claim 6, further comprising another temperature sensor to detect the temperature of the heat-moving member, wherein power to the heat source is cut off when the detected temperature of the non-contact area is greater than the set temperature and the detected temperature of the heat-moving member exceeds another set temperature.

8. The fixing device according to claim 1, wherein said heat-moving member comprises first and second divided rollers with each roller being equivalent to a half of the heat-moving member, the second divided roller having a diameter less than the first divided roller and being formed of a material having a thermal expansibility greater than a material used to form the first divided roller.

9. The fixing device according to claim 1, wherein said heat-moving member has a sheet contact area and a sheet non-contact area corresponding to a sheet contact area and sheet non-contact area of said rotatable heating member and said rotatable pressure member, said heat-moving member comprises a roller corresponding to the sheet contact area, and first and second divided rollers corresponding to the sheet non-contact area with each of the first and second divided rollers being equivalent to half of the sheet non-contact area of the heat-moving member, a diameter of the roller corresponding to the sheet contact area is equal to a diameter of the first divided roller and greater than a diameter of the second divided roller, and the second divided roller is formed of a material having a thermal expansibility greater than a material used to form both the roller corresponding to the sheet contact area and the first divided roller.

10. A fixing device for fixing toner maintained on a recording sheet by heating and fusing the toner to the recording sheet, comprising:

a rotatable heating member heated by a heat source;

a rotatable pressure member for pressing against said rotatable heating member;

a heat-moving member formed of material having excellent thermal conductivity characteristics and constructed so as to freely make contact with at least one rotatable member among said rotatable heating member and said rotatable pressure member; and a drive means to move said heat-moving member between a contact position a retracted position relative to said at least one rotatable member, said heat-moving member changing one of heat capacity and thermal conductivity relative to an axial direction of one of said rotatable heating member and said rotatable pressure member, wherein a temperature of said at least one rotatable member is controlled by the heat-moving member contacting with said at least one rotatable member.

11. The fixing device according to claim 10, wherein said heat-moving member has a sheet contact area and a sheet non-contact area corresponding to a sheet contact area and a sheet non-contact area of both of said rotatable heating member and said rotatable pressure member, a width of the sheet contact area corresponds to a minimum sheet length of the recording sheet, and a thickness of a material forming said heat-moving member in the sheet non-contact area is greater than a thickness of the material in the sheet contact-area.

12. The fixing device according to claim 11, further comprising a temperature sensor to detect a temperature of the non-contact area of at least one rotatable member among said rotatable heating member and said rotatable pressure member, wherein said drive means drives said heat-moving member to the contact position when a length of the recording sheet is less than a maximum sheet length and the detected temperature of the non-contact area is equal to or greater than a set temperature.

13. The fixing device according to claim 12, further comprising another temperature sensor to detect a temperature of the heat-moving member, wherein power to the heat source is cut off when the detected temperature of the non-contact area is greater than a set temperature and the detected temperature of the heat-moving member exceeds another set temperature.

14. The fixing device according to claim 10, wherein said heat-moving member has a sheet contact area and a sheet non-contact area corresponding to a sheet contact area and sheet non-contact area of said rotatable heat member and said rotatable pressure member, and said heat-moving member comprises a first roller corresponding to the sheet contact area and a second roller corresponding to the sheet non-contact area, thermal conductivity of said second roller is greater than thermal conductivity of the first roller.

15. The fixing device according to claim 14, further comprising a temperature sensor to detect a temperature of the non-contact area of at least one rotatable member among said rotatable heating member and said rotatable pressure member, wherein said drive means drives said heat-moving member to the contact position when a length of the recording sheet is less than a maximum sheet length and the detected temperature of the non-contact area is equal to or greater than a set temperature.

16. The fixing device according to claim 15, further comprising another temperature sensor to detect the temperature of the heat-moving member, wherein power to the heat source is cut off when the detected temperature of the non-contact area is greater than the set temperature and the detected temperature of the heat-moving member exceeds another set temperature.

17. The fixing device according to claim 10, wherein said heat-moving member comprises first and second divided rollers with each roller being equivalent to a half of the heat-moving member, the second divided roller having a diameter less than the first divided roller and being formed of a material having a thermal expansibility greater than a material used to form the first divided roller.

18. The fixing device according to claim 10, wherein said heat-moving member has a sheet contact area and a sheet non-contact area corresponding to a sheet contact area and sheet non-contact area of said rotatable heating member and said rotatable pressure member, said heat-moving member comprises a roller corresponding to the sheet contact area, and first and second divided rollers corresponding to the sheet non-contact area with each of the first and second divided rollers being equivalent to half of the sheet non-contact area of the heat-moving member, a diameter of the roller corresponding to the sheet contact area is equal to a diameter of the first divided roller and greater than a diameter of the second divided roller, and the second divided roller is formed of a material having a thermal expensibility greater than a material used to form both the roller corresponding to the sheet contact area and the first divided roller.

* * * * *